United States Patent [19]

Skrobisch

[11] 4,417,699

[45] Nov. 29, 1983

[54] APPARATUS FOR WINDING A WIRE OR THREAD ON C-SHAPED CORES

[76] Inventor: Alfred Skrobisch, 64 Fulton Blvd., Commack, N.Y. 11725

[21] Appl. No.: 322,759

[22] Filed: Nov. 19, 1981

[51] Int. Cl.[3] ..... H01F 41/06; B65H 54/30; B65H 57/24; B65H 57/28

[52] U.S. Cl. ..... 242/7.15; 242/7.03; 242/25 R; 242/157 R; 242/158 R

[58] Field of Search ..... 242/7.15, 7.16, 43 R, 242/25, 158 R, 158.1, 157 R, 157.1, 54.4, 7.06, 7.03

[56] References Cited

U.S. PATENT DOCUMENTS

| | | | |
|---|---|---|---|
| 1,233,042 | 7/1917 | Foster | 242/43 |
| 2,171,826 | 9/1939 | Duraffourg | 242/157 R |
| 2,184,390 | 12/1939 | Lovett | 242/43 |
| 3,421,706 | 1/1969 | Herubel | 242/54.4 |

*Primary Examiner*—Billy S. Taylor

*Attorney, Agent, or Firm*—Edward H. Loveman

[57] ABSTRACT

Apparatus for winding a coil or wire or thread on a C-shaped core structure where the coil width is greater than the gap through which it is being wound comprising, a stationary pedestal having a stationary base and upper platform. A first arm having a central slot engaging a stationary pin on the platform slides and turns angularly. A block and shaft are connected to one end of the arm and are reciprocated by a motor driven cam so that the end of the arm moves in a straight line. At the end of the arm is a post carrying an upper other arm which extends in cantilever fashion over the first arm. Jeweled bearings on the upper arm guide a wire to the rotating C-shaped core structure. The free end of the upper arm extends into a pole gap between ends of the core structure and moves with the lower arm in a straight line while the arms turn and slide on the pedestal, so that the coil is wound uniformly layer on layer on the rotating C-shaped core structure.

9 Claims, 5 Drawing Figures

APPARATUS FOR WINDING A WIRE OR THREAD ON C-SHAPED CORES

This invention relates to a coil winding apparatus and more particularly concerns an apparatus for winding a coil of wire or thread on a preformed C-shaped core or pole structure.

Heretofore, it has been conventional to wind a coil on a rectangular or cylindrical core and then to insert C-shaped pole pieces into an axial hole in the core, so that free end poles of the assembly project over the coil in coplanar spaced array. It has not been possible to wind the coil directly on the coil form carrying the C-shaped pole pieces because conventional coil winding machines can only wind coils cylindrically where the coil is narrower than the gap between the C-shaped pole pieces.

The present invention is directed at a coil winding mechanism or apparatus which makes it possible to wind a coil of thread or wire on a C-shaped core or pole structure wherein the width of the coil is larger than the gap between the C-shaped pole pieces. This apparatus results in economies in manufacture, since the coil assembly is complete when the wire is wound and it need not be subjected to the further step of fitting C-shaped pole pieces.

According to the invention there is provided a fixture carrying a longitudinally slotted first arm which is simultaneously pivoted on a stationary pin and moved longitudinally along the pin. A horizontal shaft and block move the free end of the arm in a straight line. The arm carries a vertical nonrotatable shaft or post on which is a secured second arm. The second arm extends in cantilever fashion horizontally over the first arm and parallel to it. The second arm carries spaced jewel bearings at opposite ends through which insulated wire is guided, drawn and wound into a coil upon a C-shaped core structure rotated on a horizontal axis. The free end of the second arm extends into a pole gap between spaced poles of the core structure to lay down the wire or thread uniformly layer upon layer. The free end of the second arm moves back and forth in a horizontal line parallel to the axis of rotation of the C-shaped core structure.

These and other objects and many of the attendant advantages of this invention will be readily appreciated as the same becomes better understood by reference to the following detailed description when considered in connection with the accompanying drawings in which.

Figure 1:
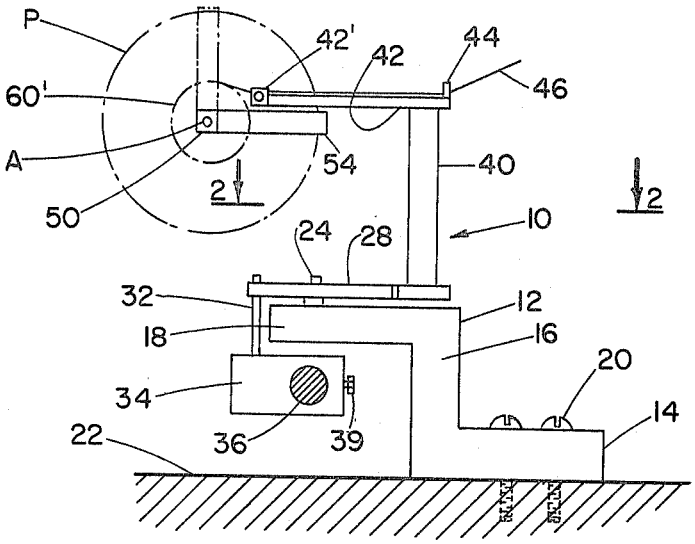
FIG. 1 is a side elevational view partially diagramatic in form of coil winding apparatus embodying the present invention.
Figure 2:
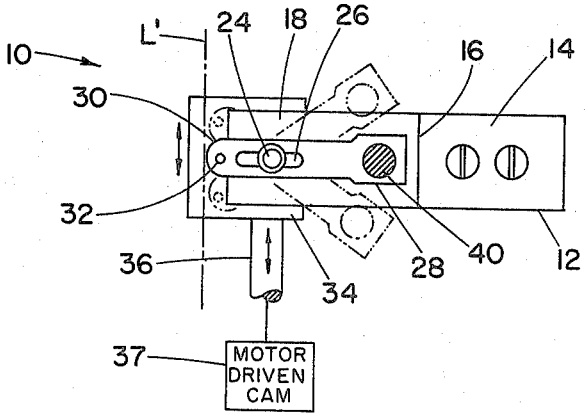
FIG. 2 is a horizontal sectional view taken along line 2—2 of FIG. 1.
Figure 4:
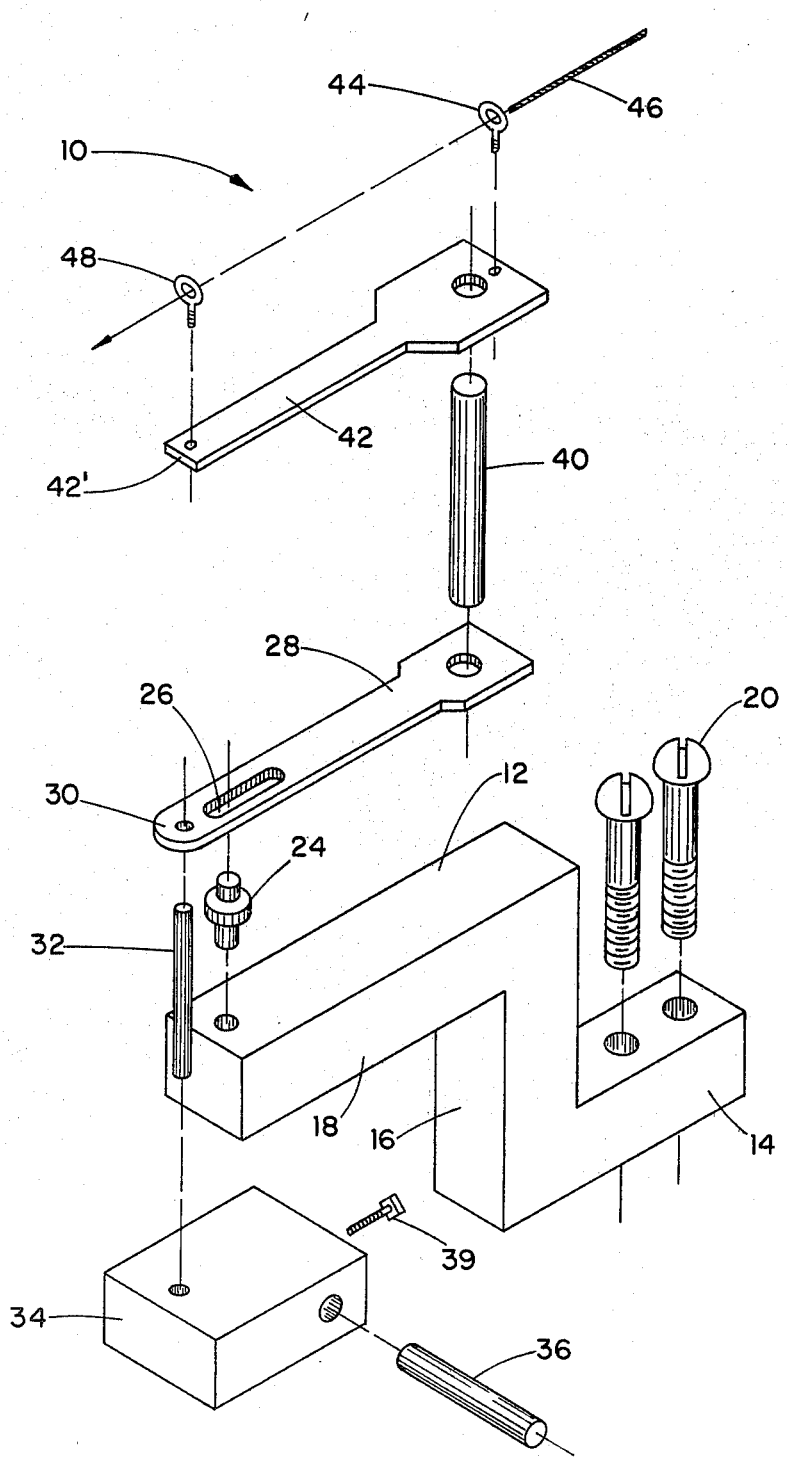
FIG. 4 is a exploded perspective view of parts of the apparatus.

Referring now to the drawings wherein like reference characters designate like or corresponding parts throughout, there is illustrated in FIGS. 1, 2, and 4, the coil winding apparatus generally designated as reference numeral 10 which has a frame like pedestal 12 provided with a horizontal base section 14, a vertical post 16 and a horizontal integral platform 18. A plurality of screws 20 hold the pedestal 12 stationary on a horizontal support 22.

The platform 18 carries a stationary pin 24 extending through a longitudinal central slot 26 in a horizontal flat arm 28. Near the free end of the arm 28 is a hole 30 in which is secured the upper end of a vertical pin shaft 32. The bottom end of the shaft 32 is secured to a block 34 which is supported by a drive shaft 36 that reciprocates axially horizontally driven by a motor driven cam 37. The block 34 and the shaft 32 move horizontally back and forth in a straight path underneath the platform 18. A screw 39 holds the block 34 on the shaft 36.

At the other end of the arm 28 is secured a vertical spacer post 40. At the upper end of the post 40 is secured one end of a flat second arm 42. At one end of the arm 42 is mounted an apertured jewel bearing 44 through which is drawn a thread or wire 46. The wire 46 is drawn through another jewel bearing 48 which is located at a point directly over the pin 32. The jewel bearing 48 is mounted at the free end 42′ of the arm 42, which extends in cantilever fashion horizontally parallel to the arm 28, so that the jewel 48 duplicates exactly the direction and movement of the pin 32.

Since the arm 28 turns angularly and also slides along the pin 24 on the platform 18, the free ends of both the arms 28 and 42 are constrained to reciprocate in straight horizontal vertically spaced parallel lines L, L′.

Figure 3:
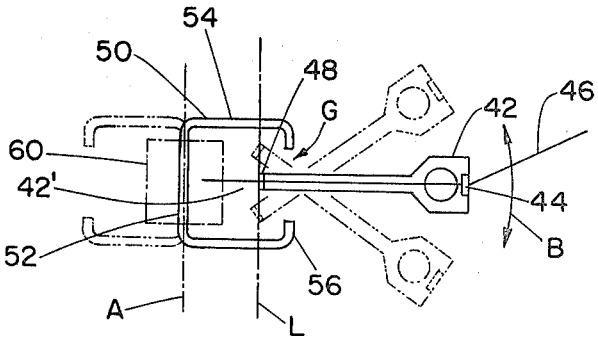
FIG. 3 is a plan view of part of the apparatus illustrating schematically the way in which a coil is wound on a C-shaped core structure.

FIG. 3 shows a rectangular X-shaped core structure 50 supported by conventional means (not shown) to rotate on an axis A parallel to a back wall 52. A pair of opposing parallel arms 54 of the core structure 50 are turned inwardly at their ends to define flat, coplanar poles 56 which are spaced apart at their inner free ends to leave a pole gap G.

FIG. 3 also shows how the arm 42 moves in a horizontal plane with a free front end 42′ carrying the bearing 48 moving in a straight line L while the rear end moves in a complex curve B. The arm 42 pivots, slides and turns back and forth between the dotted line positions shown in FIG. 3, always passing through the center of the core gap G without interfering with the rotating core 50.

The pin 24 is positioned directly under the center of the core gap G so that all movements of the arm 28 and hence the arm 42, pass through the center. It will be noted that the free end 42′ of the arm 42 terminates at the line L along which this free end 42′ moves during the winding of a coil. The winding area 60 is shown as a dotted rectangle in FIG. 3. FIG. 1 shows the cylindrical path 60′ defined by the winding area 60 as the C-shaped pole structure turns on the horizontal axis A. The cylindrical path P of the pole gap G is shown by dotted line in FIG. 1.

Figure 5:
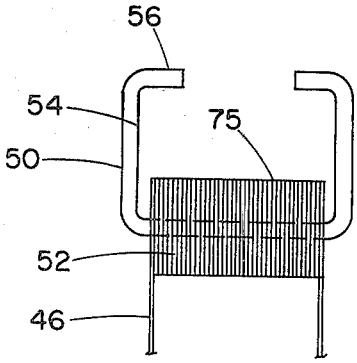
FIG. 5 is a side elevational view of the C-shaped core structure with a coil wound on it.

FIG. 5 shows a coil 75 wound with the thread or wire 46 on the core structure 50. Apparatus 10 will wind the coil 75 while the core structure 50 rotates in the manner illustrated in FIGS. 1, 2, and 3.

The apparatus described permits the winding of coils on C-shaped cores structures at high speed, precisely, automatically and economically for coil widths greater than the core gap.

It should be understood that the foregoing is related to only a preferred embodiment of the invention which has been by way of example only and that it is intended to cover all changes and modifications of the examples of the invention herein chosen for the purposes of the disclosure, which do not constitute departures from the spirit and scope of the invention.

What is claimed is:

1. Apparatus for winding a coil of wire-like material on a C-shaped core structure wherein the width of said coil is greater than the gap in said core, comprising:

an arm;

means mounting said arm for angular motion on and slideable along a stationary axis whereby one end of said arm moves in a straight line;

bearing means on said arm for carrying said wire-like material to said C-shaped core structure which has spaced free ends defining a gap there-between;

means for rotating said C-shaped core structure on another axis parallel to said straight line;

a stationary support disposing said one end of said arm through said gap between said free ends of said core structure;

another arm carried by said stationary support, rotatable on and slideable along said stationary axis;

spacer means connecting said first named and other arm in fixed parallel disposition so that both arms turn and slide identically and said reciprocable drive means including a coupling means directly engaging one end of said other arm to move the same in another straight line parallel to said first named straight line, so that said one end of said first named arm reciprocates in said gap when said drive means reciprocates said one end of said other arm back and forth along said other staight line.

2. Apparatus as defined in claim 1, wherein said support comprises a stationary pedestal pivotally and slideably carrying said other arm.

3. Apparatus as defined in claim 1 wherein said bearing means comprises spaced jewel bearings on said first named arm at opposite ends thereof for guiding said wire-like material therethrough to said core structure.

4. Apparatus as defined in claim 2, wherein said drive means comprises:

a block;

a shaft connecting said block and said one end of said other arm, and another shaft supporting said block and reciprocated by motor drive means to reciprocate said one end of each of said arms, while said wire-like material is wound uniformly into a coil on said core structure.

5. Apparatus as defined in claim 4, wherein said other arm has a longitudinal slot, and wherein said pedestal carries a stationary pin disposed in said slot so that said arms turn angularly on and slide along said pedestal when said drive means reciprocates said arms.

6. Apparatus as defined in claim 1, wherein said drive means comprises a block;

a shaft connecting said block and said one end of said other arm, and another shaft supporting said block and reciprocated by motor drive means to reciprocate said one end of each of said arms, while said wire-like material is wound uniformly into a coil on said core structure.

7. Apparatus as defined in claim 6, wherein said support comprises:

a stationary pedestal having a base;

a post extending from said base; and a platform integral with said post for pivotally and slideably carrying said other arm.

8. Apparatus as defined in claim 7, wherein said other arm has a longitudinal slot, and wherein said platform carries a stationary pin disposed in said slot so that said arms turn angularly on and slide along said platform when said drive means reciprocates said arms.

9. Apparatus as defined in claim 8, wherein said bearing means comprises spaced jeweled bearing means on said first named arm for guiding wire-like material to said core structure.

* * * * *